United States Patent [19]

Roder et al.

[11] 4,257,316

[45] Mar. 24, 1981

[54] METHOD FOR PRE-CUTTING LABELS FOR COMPOSITE CONTAINERS

[75] Inventors: Hugh H. Roder, Bridgeton; Elroy Denningmann; Dewey B. Thornhill, both of St. Charles, all of Mo.

[73] Assignee: Boise Cascade Corporation, Boise, Id.

[21] Appl. No.: 944,141

[22] Filed: Sep. 20, 1978

[51] Int. Cl.[3] ..... B31C 3/02

[52] U.S. Cl. ..... 493/68; 493/103; 493/292; 493/301

[58] Field of Search ..... 93/94 R, 80, 77 CL, 93/39.1 R, 55.1 R

[56] References Cited

U.S. PATENT DOCUMENTS

| | | | |
|---|---|---|---|
| 3,144,193 | 8/1964 | Geist et al. | 229/51 BP |
| 3,981,433 | 9/1976 | Thornhill et al. | 229/51 BP |
| 4,091,718 | 5/1978 | Thornhill | 93/39.1 R |
| 4,100,846 | 7/1978 | Reid | 93/94 R |

*Primary Examiner*—James F. Coan

*Attorney, Agent, or Firm*—Laubscher & Laubscher

[57] ABSTRACT

An improved one-step easy-open composite container for dough products and the like, together with a method and apparatus for forming the same, are disclosed, which composite container includes a fibrous body wall layer having an unbonded helical butt joint, an impervious inner liner layer that is folded to define an expansible folded portion that extends helically the length of the container opposite the helical butt joint, an outer label layer wound helically in adhesively-bonded relation upon the body wall and extending across the butt joint, and at least one end closure member closing one end of the body wall-label laminate, characterized in that the outer label layer is provided—prior to winding on the body wall layer—with a collar-defining line which extends circumferentially about the resulting tubular laminate adjacent and spaced from the end closure member. Consequently, when the triangular pull tab portion defined by the collar-defining line and helically extending label layer edge is pulled to partially tear the label from the container along the circumferential collar-defining line, the body wall butt joint is exposed and is automatically expanded by the product packaged in the container to open the inner liner layer folded portion along the butt joint. In one embodiment, the collar-defining line is a scoreline, and in an alternative embodiment, the collar-defining line is a continuous through-cut.

1 Claim, 10 Drawing Figures

Fig. 1
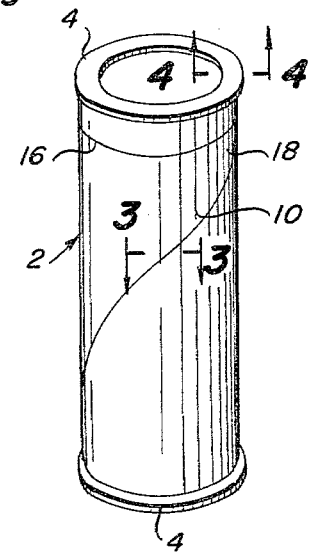
Fig. 2
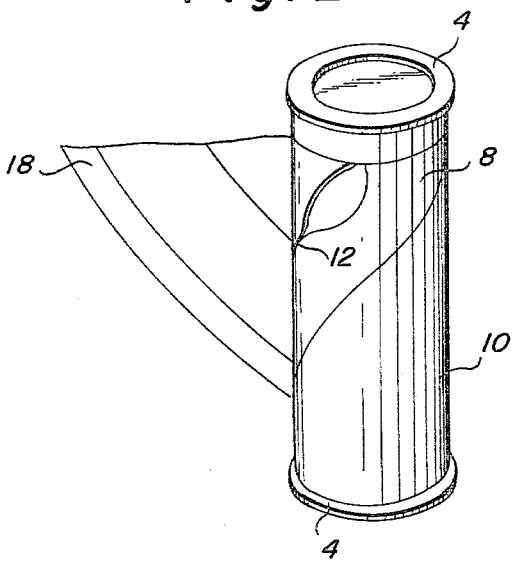
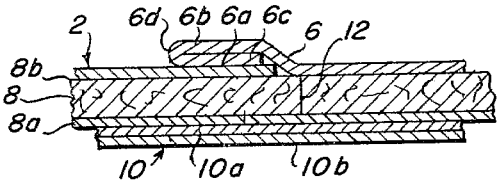
Fig. 3
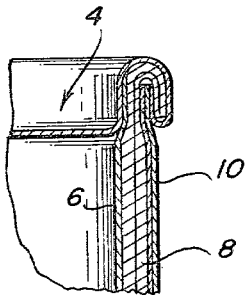
Fig. 4
Fig. 5
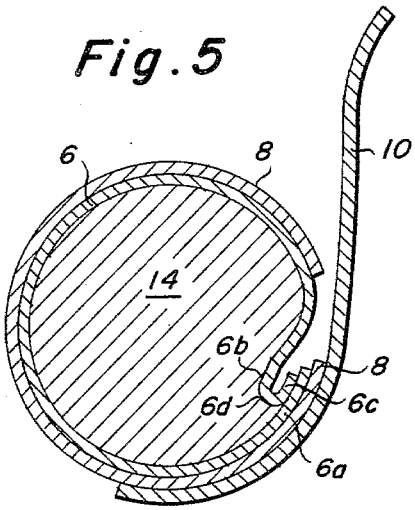
Fig. 6
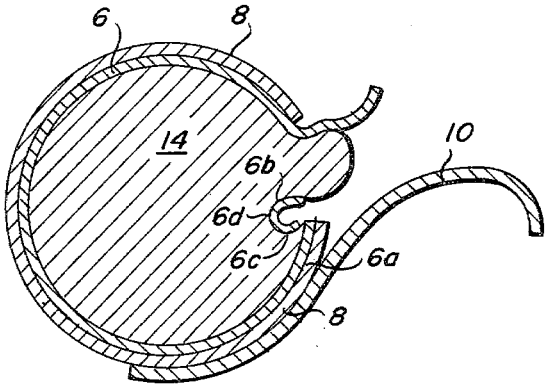

METHOD FOR PRE-CUTTING LABELS FOR COMPOSITE CONTAINERS

BRIEF DESCRIPTION OF THE PRIOR ART

The use of composite containers having circumferential collar cuts for packaging products such as biscuit dough and the like are well known in the patented prior art as evidenced by the patents to Geist et al U.S. Pat. No. 3,144,193 and Thornhill et al U.S. Pat. No. 3,981,433. In the aforementioned Geist et al patent, there is disclosed a composite container having a circumferential collar cut that extends completely through the label layer adjacent one metal end closure member to define at one edge portion thereof a triangular-shaped pull tab portion. By means of this pull tab portion, the outer label layer may be removed from the container, whereupon the container is struck laterally against a sharp edge surface (of a kitchen counter of table, for example) to effect bursting of the body wall along the helical butt joint container therein.

In the Thornhill et al U.S. Pat. No. 3,981,433, a one-step easy-open container for refrigerated dough products and the like is disclosed in which the container automatically opens (owing to the pressure of the dough product packaged therein) when the label layer is partially removed from the container by pulling on a tab portion defined in the label layer by a circumferential collar cut scareline provided in the outer surface of the container. To this end, the unbonded helical butt joint of the body wall layer is straddled on its inner surface by a helically extending expansible fold portion of the impervious liner layer.

The aforementioned composite containers possess certain inherent structural and/or functional drawbacks. In the collar cut containers, the circumferential cut extends completely around the container, thereby intersecting the abutted edges of the helical seal of the fibrous body wall layer to produce a critically weak area adjacent the point of intersection. Thus, the inner liner layer is the only material holding the pressurized product in at that point. Furthermore, when the collar cut is formed in the composite container wall, generally the collar cutting means extends not only through the label layer, but also partially into the fibrous body wall layer (up to a depth of 0.010 inches or more) thereby weakening the body wall of the container circumferentially. Furthermore, in a collar cut container, the moisture formed by condensation on the outer surface of the container penetrates the collar cut and into the fibrous body wall layer, thereby weakening the container strength and, in some cases, causing the container to burst open at the helical seam. Moreover, the cutting of a circumferential collar cut on a container, or a partial collar cut on a completed container, requires additional handling and supporting of the container during manufacture, thereby increasing tooling costs and unit manufacturing time.

In view of the aforementioned difficulties, the improvements disclosed in the Beauchamp applications Ser. Nos. 789,084 and 888,783 and the Thornhill Pat. No. 4,091,718 and application Ser. No. 864,009 were developed. The Beauchamp applications disclose a composite container, and the method and apparatus for making the same, including a helically wound label layer which contains a line of perforations that extends circumferentially adjacent and spaced from a metal end closure member, thereby to define a line of tear along which the label layer may be torn from the container. The Thornhill patent and application disclose a composite container, and the method and apparatus for making the same, including a helically wound label layer which contains a tab cut which defines a pull tab portion which facilitates the tearing of the label layer from the container.

While the prior containers having a pre-cut label layer as disclosed in Beauchamp and Thornhill normally operate quite satisfactorily, they do possess the inherent drawback that the label layer is not always torn along a definitive line of tear. In the self-opening containers for refrigerated dough products and the like, it is necessary for proper opening of the container that the label layer be torn along a circumferential collar-defining line adjacent one end of the container.

SUMMARY OF THE INVENTION

Accordingly, a primary object of the present invention is to provide an improved one-step easy-open composite container for dough products and the like in which the label layer is provided —prior to the winding thereof onto the body wall layer—with a collar-defining line which extends circumferentially about the resulting tubular laminate and is adjacent and spaced from the end closure member. The collar-defining line and the overlapping edge of the label layer define a pull tab portion for initiating tearing the label layer from the container. In a preferred embodiment, the collar-defining line is a scoreline which extends only partially through the outer surface of the label layer thereby eliminating the area of the body wall layer that may be exposed to moisture. Furthermore, since the collar-defining line is formed in the label layer prior to winding the label layer on the machine, the fibrous body wall layer will not be cut thereby eliminating the weaknesses of prior body wall layers. Consequently, material cost savings to the manufacturer has the advantage of eliminating the scoring knives at the tube cutting station and related tooling and maintenance of this tooling. Overall, tooling cost, spoilage and maintenance downtime are greatly reduced.

In accordance with a more specific object of the invention, the novel label containing the collar-defining line is used in connection with a fibrous body wall layer having an unbonded helical butt joint across which is mounted an impervious inner linerlayer which is folded to define an expansible portion that extends helically of the container opposite the body wall butt joint. When the resulting pull tab is pulled to partially tear the label layer from the container circumferentially adjacent the metal end, it will tear for a distance sufficient to expose the butt joint which expands (owing to the pressurized dough product) to separate the edges thereof and, consequently, to expand the folded inner liner portion to automatically open the same, thereby to permit removal of the packaged dough product from the container.

BRIEF DESCRIPTION OF THE FIGURES

Other objects and advantages of the invention will become apparent from a study of the following specifications when viewed in the light of the accompanying drawing, in which:

FIG. 1 is a perspective view of the composite container of the present invention;

FIG. 2 is a perspective view of the container of FIG. 1 with the label layer partially torn away to permit automatic bursting of the inner liner layer along the helical body wall butt joint;

FIGS. 3 and 4 are sectional views taken along lines 3—3 and 4—4, respectively, of FIG. 1;

FIGS. 5 and 6 are transverse sectional views of the container illustrating the one-step opening operation of the container;

DETAILED DESCRIPTION

Figures 7, 8, 9:
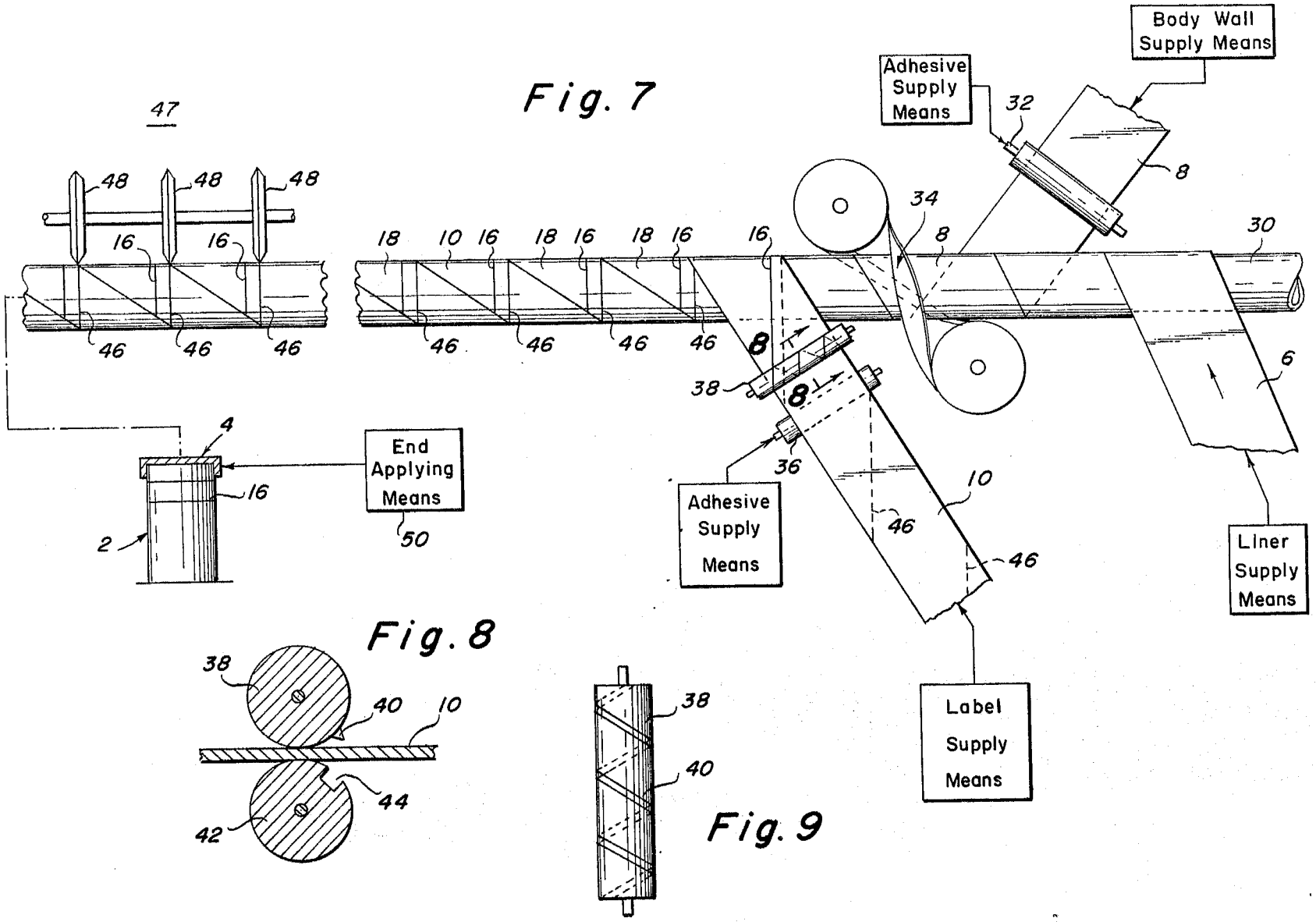
FIG. 7 is a somewhat diagrammatic top view of a first method and apparatus for producing the composite container of FIG. 1.
FIG. 8 is a detailed view taken along line 8—8 of FIG. 7.
FIG. 9 is a front plan view of the rotary cutting means.

The composite container of the present invention includes a tubular composite body wall the upper and lower ends of which are closed by conventional metal end closure members 4. The composite body wall layer includes an impervious inner layer 6, a fibrous body wall layer 8, and an outer label layer 10, which layers are helically wound in the same sense upon a mandrel and are adhesively bonded together by a conventional liquid adhesive (for example, a polyvinyl alcohol adhesive). More particularly, the impervious inner liner layer 6 is formed from a metal foil-kraft paper laminate, the paper layer of which is bonded to the fibrous body layer 8. Similarly, the outer label layer 10 may comprise a metal foil-kraft paper laminate, the paper layer 10*a* of which is bonded to the fibrous body wall layer 8, and the metal foil layer 10*b* of which is exposed and carries the printed advertising indicia. In order to assist tearing of the label layer from the fibrous body wall layer, the fibrous body wall layer 8 may include a surface portion 8*a* tht is formed from reprocessed newspaper stock, the remaining portion 8*b* of the fibrous body wall layer 8 being formed of reprocessed kraft paper.

As in the invention disclosed in the aforementioned Thornhill et al U.S. Pat. No. 3,981,433, the adjacent edges of the helical butt joint 12 contained in the fibrous body wall layer 8 are unbonded, one edge portion 6*a* of the inner liner layer 6 terminating short of the butt joint. The other longitudinal edge portion of 6*b* of the inner liner layer 6 extends in straddling relationship across the butt joint and above the first edge portion 6*a*, said second edge portion being reversely folded back upon itself to define a third inner liner portion 6*c* that extends between the first and second liner portions 6*a* and 6*b*. The third liner portion 6*c* terminates short of the butt joint 12 and at least the free extremity thereof is bonded to the adjacent edge of the first edge portion 6*a*. Thus, the inner liner portion 6*a*, 6*b* and 6*c* define an expansible folded seam tht straddles the unbonded butt joint 12 and isolates the same from the moisture of a product, such as unleavened dough 14 in the form of biscuits.

In accordance with the present invention, the label layer 10 is provided with a continuous collar-defining line 16 which extends circumferentially about the resulting tubular laminate, adjacent and spaced from one end of the laminate. The collar-defining line 16 and the overlapping edge of the label layer 10 define a pull tab portion 18 on the label layer. As shown in FIG. 2, when the user pulls on the pull tab portion 18, the label layer 10 is progressively torn from the body layer 8 along the continuous circumferential collar-defining line 16 to expose the unbonded butt joint, whereupon the pressure of the packaged dough product causes the mating edges of the butt joint to separate to permit progressive expansion of the inner layer 6. As shown in FIGS. 5 and 6, the inner liner 6 is caused to rupture either at a line of weakness defined by a creased fold line 6*d*, or by pulling the reversely folded third portion 6*c* progressively away from the inner liner first edge portion 6*a*. The label layer 10 is progressively removed by tearing along the line 16 until a sufficient portion of the butt joint 12 is exposed to permit the expansion thereof by twisting the metal end members 4 in opposite directions to further open the butt joint to permit the removal of the packaged products from the container.

Referring now to FIG. 7, it will be seen that the inner liner layer 6 is initially helically wound upon a stationery mandrel 30, and the fibrous body wall layer 8 has a layer of liquid adhesive applied to the upper surface thereof by an adhesive-applying roller 32 prior to the helical winding thereof upon the outer surface of the liner layer 6. The body wall-inner liner layer laminate is longitudinally displaced to the left on the mandrel 30 by means of conventional belt conveying means 34.

The outer label layer 10 is fed longitudinally in edge-overlapping relation to the mandrel 30 and is coated on its lower surface with a layer of liquid adhesive by the adhesive supply means 36. In accordance with the present invention, the label layer passes through a rotary cutting means 38 as shown in FIGS. 8 and 9. The rotary cutting means 38 has a relatively shot helical blade 40 arranged on the outer surface thereof to form in the label layer 10 a plurality of successive parallel collar-defining lines 16. The helical blade 40 has a pitch such that the resulting collar-defining lines extend circumferential about the resulting tubular laminate. A backup roll 42 containing a slot 44 for receiving the knife blade 40 is arranged opposite the rotary cutting drum 38. In a preferred form, the helical blade 40 does not cut completely through the label layer 10, whereby each collar-defining line 16 comprises a scoreline extending partially within the label layer 10. The scorelines extend continuously between the opposite edges of the label layer strip. The pre-scored label layer is then wound helically in edge-overlapping adhesively bonded relation upon the outer surface of the body wall layer 8, the scoreline extending circumferentially about the tubular laminate and being adjacent and spaced from the end cut severing lines 46 (which may or may not be printed on the label layer). The resulting laminate is conveyed by the belt conveyor means 34 toward a cutting station which cuts the tubular laminate into cylindrical sections along circumferential cuts defined by the dividing lines 46. Alternatively, the laminate could be severed in desired longer lengths (for example, an eight can length), and be removed from the mandrel 30 for severing into sections at another cutting station, as desired. In any event, the severed sections are transported to an end applying station 50 at which a metal end 4 is connected with the composite tubular body wall 2 in any conventional manner (for example, by the rolled seam illustrated in FIG. 4).

Figure 10:
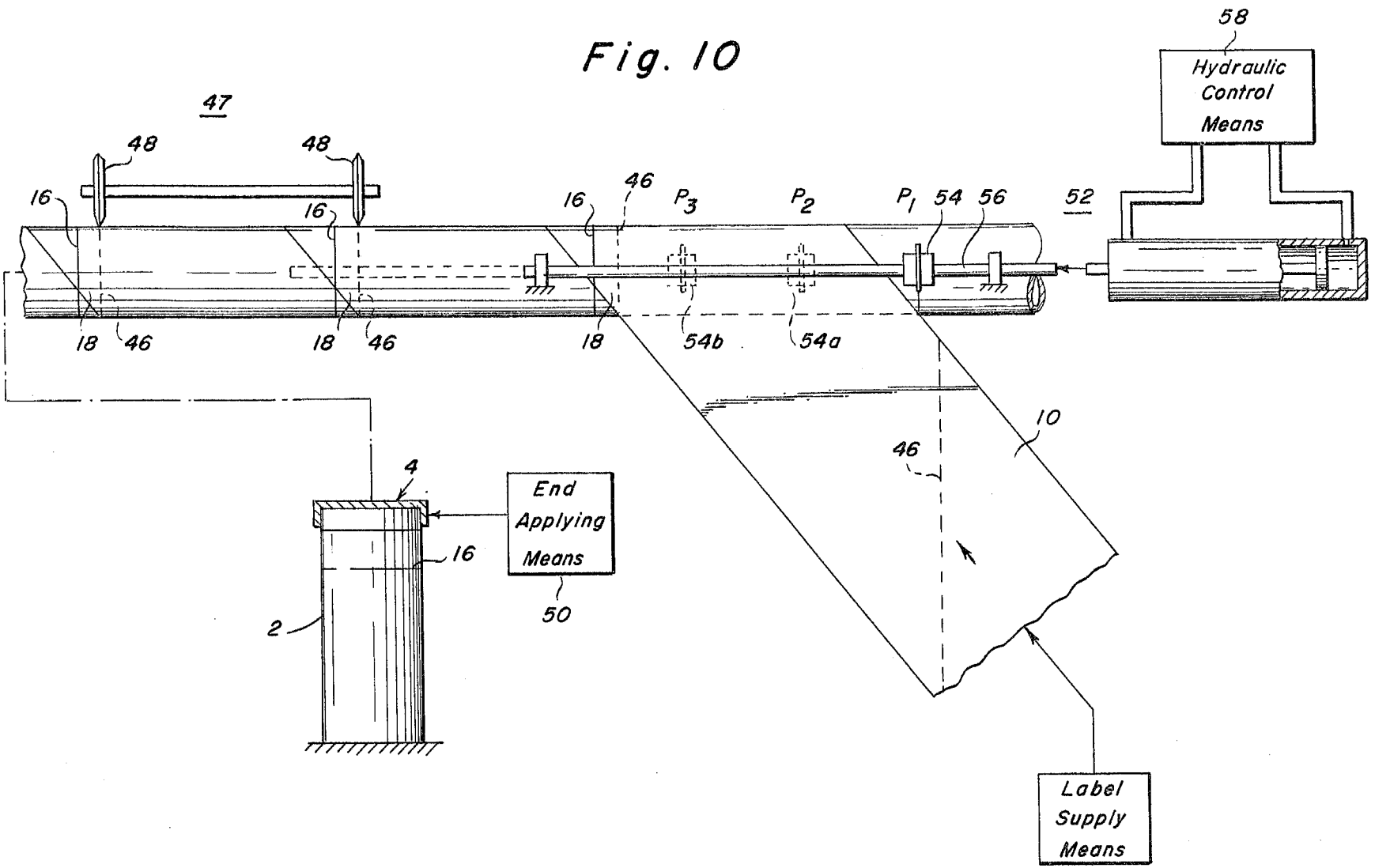
FIG. 10 is a somewhat diagrammatic top view with certain parts removed, of a second method and apparatus for producing the composite container of FIG. 1.

Referring now to the modification of FIG. 10, the rotary cutting means 52 comprises a rotary circular cutting blade 54 rotatably mounted for rotation about a shaft 56 the axis of which is parallel with the axis of the mandrel 30. Hydraulic control means 58 axially displaces the rotary cutting blade 54 for linear movement adjacent the mandrel, as shown by the positions $P_1$, $P_2$ and $P_3$, in synchronization with the winding of the label layer. When the rotary cutting blade reaches the end position $P_3$, it is returned to its original position $P_1$ in order to form the next successive collar-defining line 16. In its preferred form, the collar-defining line in this embodiment comprises a continuous through-cut. Thus in operation, the leading edge of the label layer is wound on the fibrous body layer following which the rotary cutting blade 54 is driven in synchronization with the winding of the remaining portion of the label layer to form the collar-defining through-cut in the remaining body portion and overlapping edge portion of the label layer. As in the embodiment of FIG. 7, the collar-defining line 16 is circumferentially arranged adjacent and spaced from the metal end of the container and cooperates with the label layer edge to define the pull tab portion 18 on the label layer 10. Thus, in both embodiments of the invention, the collar-defining lines 16 are formed in the label layer prior to the winding thereof on the mandrel upon the outer surface of the fibrous body wall layer.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. In a method of manufacturing a composite container for dough products and the like, including the steps of helically winding on a mandrel an impervious inner liner layer strip; helically winding a fibrous body wall layer strip in the same sense as, and in adhesively bonded relation on the external surface of, said helically-wound inner liner layer, thereby to define a body wall layer containing a helical unbonded butt joint, said liner layer including a helically extending expansible folded portion bonded to said body wall layer on both sides of, and extending in straddling relation across, said helical butt joint; helically winding a label layer strip in adhesively-bonded relation on the external surface of said body wall layer, thereby to form a tubular laminate, said label layer being wound in edge-overlapping relation with one edge portion being exposed; transversely cutting the tubular laminate along longitudinally spaced lines of circumferential end cuts contained in planes normal to the longitudinal axis of the tubular laminate, thereby to define a plurality of cylindrical laminate sections; and securing to one end of the laminate section a metal end closure member, the improvement which comprises forming a plurality of longitudinally spaced parallel collar-defining scorelines in the label layer strip prior to the winding of said strip on the external surface of said body wall layer, said collar-defining scorelines extending continuously between said one edge of said label layer strip and the opposite edge of said label layer strip, said collar-defining scorelines further extending circumferentially about the resulting tubular laminate section, each of said collar-defining scorelines further defining a pull tab portion between said scoreline and said label layer one edge, whereby upon pulling of the tab portion of the label layer, the label layer is torn from the container assembly along the circumferential collar-defining scoreline adjacent the metal end closure member.

* * * * *